US005641167A

United States Patent [19]

Behm et al.

[11] Patent Number: 5,641,167

[45] Date of Patent: Jun. 24, 1997

[54] INSTANT BINGO GAME CARD

[76] Inventors: William F. Behm, 2250 Rolland St., Marietta, Ga. 30062; Mark C. Tevis, 4285 Habersham Way, Cumming, Ga. 30130

[21] Appl. No.: 279,293

[22] Filed: Jul. 22, 1994

Related U.S. Application Data

[63] Continuation-in-part of Ser. No. 51,912, Apr. 22, 1993, abandoned.

[51] Int. Cl.[6] ..... A63F 3/06

[52] U.S. Cl. ..... 273/269; 273/139; 283/901

[58] Field of Search ..... 273/269, 139; 283/72, 73, 74, 94, 95, 96, 97, 98, 109, 114, 903

[56] References Cited

U.S. PATENT DOCUMENTS 4,466,614 8/1984 Bachman et al. ..... 273/139
4,491,319 1/1985 Nelson ..... 273/1
5,083,815 1/1992 Scrygeour et al. ..... 283/72

FOREIGN PATENT DOCUMENTS 2136374 12/1972 France .
2024022 1/1980 United Kingdom .

*Primary Examiner*—William M. Pierce

[57] ABSTRACT

The playability of an instant bingo game card or similar type game cards can be enhanced by providing for improved marking of numbers on a player card portion of the bingo card. In one approach, a space is provided along side each number in which a mark is printed and a scratch-off coating is applied over the mark. In a second approach, a microencapsulated pressure sensitive dye is applied over each number and by simply rubbing a particular number can be marked.

28 Claims, 2 Drawing Sheets

INSTANT BINGO GAME CARD

CROSS-REFERENCE TO RELATED APPLICATIONS

This application is a continuation-in-part of U.S. Ser. No. 08/051,912, filed Apr. 22, 1993, now abandoned.

TECHNICAL FIELD

The invention relates to the field of instant lottery tickets and in particular to instant bingo game cards.

BACKGROUND OF THE INVENTION

The purpose of an instant bingo card or ticket is to simulate the play of a conventional bingo game utilizing instant lottery technology. An instant bingo card will normally include a caller card portion which has a number of combinations of letters and numbers covered by a latex or scratch-off coating. The letter-number combinations on the caller's card correspond to the letter-number combinations found on the balls that are typically drawn in a conventional bingo game. There are normally twenty five letter-number combination printed under the scratch-off coating. Also printed on an instant bingo card is a group of usually four to six player cards which are similar in format to bingo cards used by players in conventional bingo games. To play the game, a player will scratch off the coating over the letter-number combinations on the caller's card and mark on each of the player cards any numbers that may correspond to letter-number combinations on the caller's card. Usually printed on the instant bingo card adjacent to the player cards is an indication of the combinations that will result in the awarding of a prize. After marking the player cards, the player is able to determine if one or more of the player cards represent a winning combination and if a winning combination is present, the player can then present the card to a lottery agent to redeem the indicated prize(s).

One of the challenges of producing a commerically satisfactory instant lottery card is to provide a method for marking the player cards which is convenient to use yet economical to manufacture. In one approach the numbers on the player cards are covered by a scratch-off coating and numbers corresponding directly to the numbers printed on the player card are printed, utilizing for example a technique disclosed in U.S. Pat. No. 5,074,566, on the scratch-off coating. The player is then able to mark his cards by scratching off the numbers on his player card corresponding to the letter-number combinations on the caller card portion of the instant bingo card. This approach has two disadvantage in that it requires a second scratch-off area and more importantly requires two separate printings of the numbers on the player cards. These factors substantially increase the manufacturing cost of the card. The second scratch-off area also results in a great deal more scratch-off debris following the play of the game.

A second technique, as disclosed in U.S. Pat. No. 5,193,815, is to print a translucent coat of a scratchable material over the player cards which is pigmented so as to modify the appearance of the color of the area under the translucent coat. By scratching off the translucent coat over a particular number on the player cards, the player can mark this number by the resulting apparent color change. This approach has three disadvantages. First, when effecting the color change the player's card area always changes from a darker color to a lighter color. This is the opposite of how a player marks his card in an actual bingo game. Second, the color(s) of the player's cards before rubbing (marking) are always created colors. The created color(s) are the combination of the color of the underlying layer on which the player's numbers are printed and the color of the translucent tinted layer. Colors created in this fashion are limited by the tint of the scratch-off translucent layer. The color of the translucent layer is limited in that it must be of sufficient contrast to result in easily discernible marks of the player's card when removed but not so dark as to make reading of the players number difficult prior to removal. Finally, the scratch-off layer over the player's cards results in more scratch-off debris following play of the game.

Another problem which relates to instant game cards in general is the propensity among certain persons to attempt to cheat a lottery by cutting and pasting symbols on its game cards in order to make a non-winning game card appear to be a winner. It is therefore desirable to provide a method which will indicate by simple inspection of the game card that an attempt has been made to alter the card. This is especially desirable for game cards that represent relatively low wining amounts because these cards are not normally subjected to the rigorous inspections and validations of high value winners.

SUMMARY OF THE INVENTION

It is therefore an object of the invention to provide an instant bingo card having player cards with a method of marking numbers on the player cards that result in high contrast with a minimum in production costs and less scratch-off debris following play of the game.

Another object of the invention is to provide an instant bingo card having player cards with a relatively small marked space located adjacent to each number on the player cards covered with a scratch-off coating. To mark a number the player scratches off the coating adjacent to the number revealing an indicator symbol such as a red "x".

A further object of the invention is to provide an instant bingo card having player cards where numbers on the player cards can be marked by simply applying pressure to the numbers to be marked. To accomplish this objective, a color former and an activator are applied to the player card area. By microencapsulating either the color former or the activator, color change is inhibited until pressure is applied by the player to the number to be marked. In one embodiment of the invention, the color former is applied over the numbers printed on the card substrate in microencapsulated form and the activator or color developer is laid down. To protect the microcapsules, stilt particles, such as starch or polypropylene particles having diameters significantly larger than the microcapsules, are included with the color former and the activator during the printing process in order to keep the capsules from being crushed during printing. Also, a clear abrasion resistant material is placed over the microcapsules in order to give additional protection during the printing process.

DETAILED DESCRIPTION OF THE INVENTION

Figure 1:
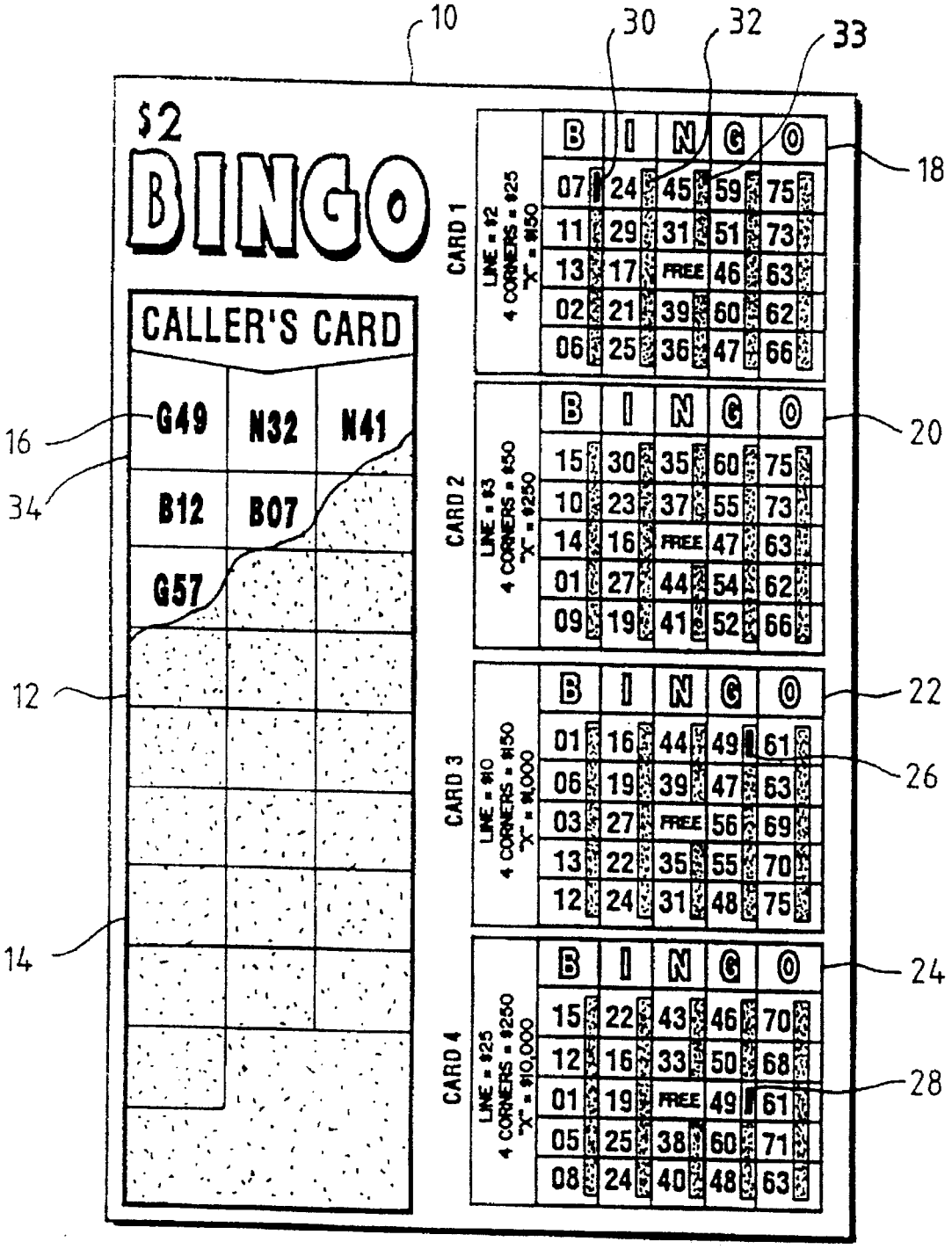
FIG. 1 is a plan view of an instant bingo card having a set of player cards which include a space containing a mark covered by a scratch-off coating located adjacent to each number printed on the card.

FIG. 1 shows a top view of a representative game card 10, in this case an instant bingo game card, employing a first embodiment of the invention. Located on the left side of the card 10 is a caller's card portion 12 illustrated in broken away form with the lower portion showing a latex scratch-off material 14. The upper portion shows a set of play indicia, here a group of letter-number combinations, represented generally at 16 that are printed on the card 10 underneath the scratch-off coating 14. It is the letter-numbers 16 that are equivalent to the letter-numbers that appear on balls drawn in a convention bingo game. Arrayed on the right hand side of the card 10 is a group of four players cards 18–24 each of which includes a column of five numbers located below each of the letters BINGO. Along side each of the numbers printed on the players cards 18–24 is a space containing a mark as shown by the representative examples 26, 28 and 30. Each of the marks represented at 26–30 is covered by a scratch-off material of the same type used for the scratch-off material used on the caller's card 12 as shown for example at 32 and 33. During manufacture of the card 10, the latex covers, represented at 26–30 placed over the marks on the players cards 18–24, are applied in the same process step as the covering 14 on the caller's card 12.

The marks as shown at 26–30 facilitate the playing of the bingo game on the card 10 by making it possible for the player to mark the letter-number combinations 16 that appear on the caller's card 12 on each of the players cards 18–24. For example, the letter-number combination G49 that is printed a location 34 on the caller's card 12 can readily be marked on the players cards 22 and 24 by simply removing the scratch-off coating covering these marks 26 and 28 which are adjacent to the numbers 49 printed on the players cards 22 and 24. Visual perception of the marks 26–30 can be enhanced by selecting a color for the marks such as 22 and 24 that provides for maximum contrast between the marks and the background material on the players cards 18–24 upon which the numbers are printed. For example, red can be used for the marks 26–30 where the background material on the players cards 18–24 is yellow, white, light blue and light green, respectively. Thus this embodiment of the invention permits the selection of a wide variety colors for the players cards 18–24 so that the cards 10 can be designed for maximum player appeal while at the same time promoting ease of use by the players.

Figure 2:
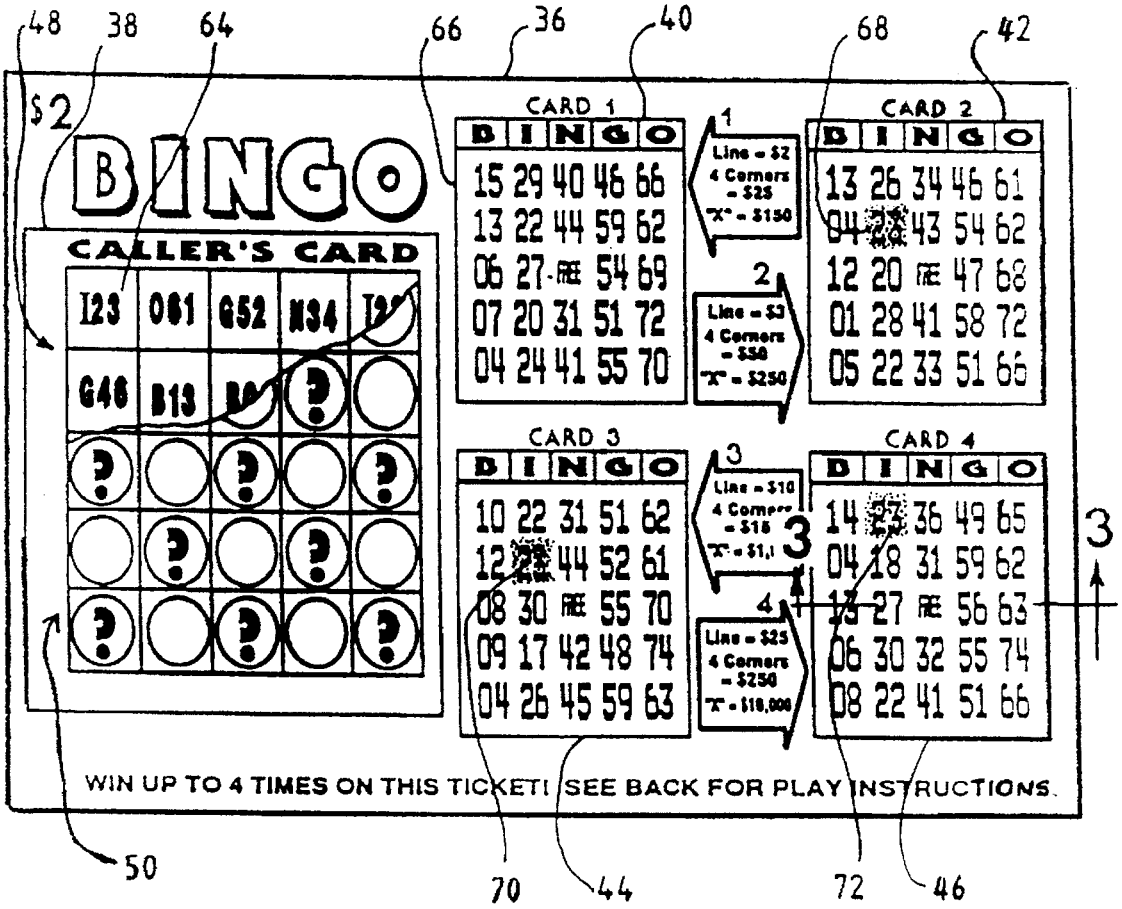
FIG. 2 is a plan view of an instant bingo card having a set of player cards with a color former and an activator applied thereto.
Figure 3:
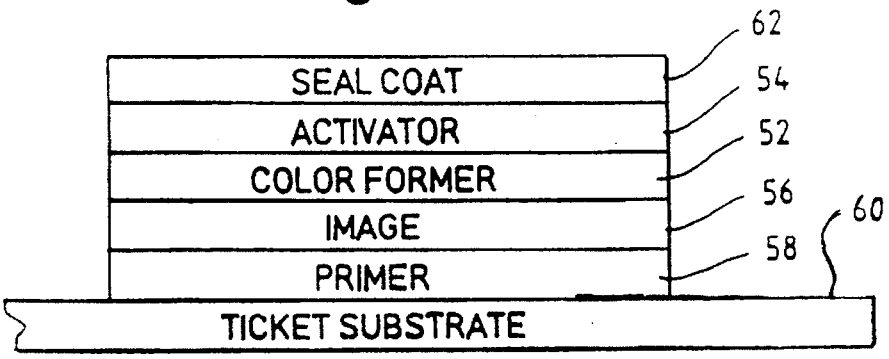
FIG. 3 is a partial cross sectioned view along lines 3—3 of FIG. 2.

A second embodiment of the invention is illustrated in FIGS. 2 and 3. A top view of an instant bingo game card 36 having a caller's card portion 38 and a set of four players cards 40–46 is shown in FIG. 2. As with the card 10 of FIG. 1, the caller's card 38 has a group of letter-number combinations or indicia indicated at 48 printed below a scratch-off latex covering indicated at 50 and the players cards 40–46 contain a column of five numbers aligned below each of the letters BINGO. In this embodiment of the invention the marking of the numbers in the players cards 40–46 is provided for by applying a color former 52 and an activator 54 over a number image 56 printed on a primer surface 58 that is applied to a card substrate 60 as shown in FIG. 3. A clear abrasive resistant coating such as seal coat containing a vinyl resin or an ultra-violet curable seal coat 62 is applied over the activator. It is highly desirable to apply a tough film such as the abrasion resistant coating 62 over the color former 52 and the activator 54 in order to prevent the combination of the color former 52 with the activator 54 during the printing process. In addition, the abrasion resistant coating 62 will tend to protect the color former 52 and activator 54 during handling of the card 36. Also, absence of this layer 62 would allow the abrasive action of a serrated coin to rub off the color former and activator layers 52 and 54 before any color change and subsequent marking could take place. The marking indicia, here the numbers on the players cards 40–46 are marked by pressing on the particular number to be marked which has the effect of combining the color former 52 with the activator or developer 54 to produce a visible color change on the number. A dye or equivalent substance is included in the color former 52 that is sufficiently different in color from the color of the back ground on the substrate 60 to result in a readily perceivable mark. For example, the player would mark the letter-number combination I23 which appears at 64 on the caller's card 38 by pressing on a corresponding number 68–72 on one of the players cards 40–46. The shaded portion of the player's cards 42–46 covering the numbers 68–72 is used to represent in FIG. 2 the visual effect of the dye. To prevent premature mixing, either the activator 54 or the color former 52 are microencapsulated.

In the preferred embodiment, the color former 52 has the following composition by weight: an aqueous dispersion of a micro- encapsulated blue leuco dye where the microspheres are 4–10 microns, 46.5%; an acrylic copolymer, 8%; water, 12.9% isopropyl alcohol, 15%; a non-ionic surfactant, 1% modified dimethyl polysiloxane, 5.0%; large granule wheat starch having a particle size of 16–32 microns, 7.5%; water, 5%; ammonium hydroxide, 0.3% and water 3.3%.

The preferred activator 54 formulation has the following composition by weight: normal propyl acetate, 27.44%; ethyl alcohol, 7.2%; phenolic resin, 24.46%; acrylic resin, 15.0%; ss nitrocellulose (30% dry), 8.5%; ethyl alcohol, 5%; and ethyl acetate, 12.5%.

The above formulations including a water based color former lacquer 52 and solvent based activator 54 represent the preferred compositions, however, it will be understood that the activator 54 could also be a water based system and the color former 52 could be solvent based. Also, the activator 54 can be microencapsulated. As can be appreciated, the object of microencapsulating one or the other is to separate the color former 52 from the activator 54 until pressure is applied by a player to the number on one of the player cards 40–46 that he desires to mark.

It is also desirable to include in both of the above compositions stilt particles such as the wheat starch mentioned above or polypropylene particles in order to protect the micro-encapsulated particles from being crushed during priming of the card 36. This is especially important where a gravure type printing method is used.

Another important feature of the invention is that the color former 52 and the actuator 54, as described above, can form a clear layer over the number or image 56 on the player's cards 40–46. In this manner, maximum contrast can be provided for between the marked and unmarked numbers on the player's cards 40–46. Also, it is possible to print a developable symbol such as an "x" in register over each of the numbers on the player's cards 40–46 using the actuator 54 and color form 52. Rubbing the number would then produce the symbol as a mark for the number.

A further feature of the invention results from the fact that a number of color formers 52 having different colored dyes can be used on a game card such as 36. For example, the blue leuco dye could be used to mark certain indicia on the game card while another color dye such as red leuco or black leuco which responds to the same activator 54 could be printed over other indicia. In this manner a game can be constructed where the rubbing the indicia having one of the colors would result in a bonus prize. Manufacture of the game cards in this instance can be simplified by using the same activator 54 for the different color dyes.

We claim:

1. A game card comprising:

a substrate having a caller's card area and at least one players card area;

a plurality of letter-number combinations printed on said caller's card area;

a scratch-off coating applied over said letter-number combinations;

a plurality of numbers printed on said players card area; and a pressure sensitive microencapsulated dye applied over said numbers effective to mark any of said numbers in response to the application of pressure.

2. The card of claim 1 wherein said dye includes a color former in contact with an activator.

3. A game card comprising:

a substrate having a caller's card area and at 1 least one players card area;

a plurality of letter-number combinations printed on said caller's card area;

a scratch-off coating applied over said letter-number combinations;

a plurality of numbers printed on said players card area; and a pressure sensitive dye including a color former in contact with an activator, wherein said activator is microencapsulated, applied over said numbers effective to mark any of said numbers in response to the application of pressure.

4. A game card comprising;

a substrate;

a first plurality of play indicia printed on said substrate;

a second plurality of play indicia printed on said substrate;

a scratch-off coating applied over said play indicia;

a first plurality of marking indicia printed on said substrate;

a first pressure sensitive dye having a first color applied to said first plurality of marking indicia wherein said dye is responsive to pressure applied by a player to one of said first marking indicia to produce a change in color of said one of said first marking indicia to said first color;

a second pressure sensitive dye having a second color applied to said second plurality of marking indicia wherein said dye is responsive to pressure applied by a player to one of said second marking indicia to produce a change in color of said one of said second marking indicia to said second color; and wherein said first dye and second dye are included in a first and a second color former respectively and an activator is disposed to said first and said second color former.

5. The game card of claim 4 wherein said first color is blue.

6. The game card of claim 5 wherein said first dye is leuco blue.

7. The game card of claim 5 wherein said first dye is leuco blue and said second dye is leuco black.

8. The game card of claim 4 wherein said second color is black.

9. The game card of claim 4 additionally including a clear abrasive resistant coating covering said first and said second pressure sensitive dye.

10. The game card of claim 9 wherein said clear abrasive resistant coating includes vinyl resin.

11. The game card of claim 9 wherein said clear abrasive resistant coating includes an ultra-violet cured seal coat.

12. A game card comprising;

a substrate;

a first plurality of play indicia printed on said substrate;

a second plurality of play indicia printed on said substrate;

a scratch-off coating applied over said play indicia;

a first plurality of marking indicia printed on said substrate;

a first pressure sensitive dye having a first color applied to said first plurality of marking indicia wherein said dye is responsive to pressure applied by a player to one of said first marking indicia to produce a change in color of said one of said first marking indicia to said first color;

a second pressure sensitive dye having a second color applied to said second plurality of marking indicia wherein said dye is responsive to pressure applied by a player to one of said second marking indicia to produce a change in color of said one of said second marking indicia to said second color; and wherein said first dye and second dye are microencapsulated.

13. The game card of claim 12 wherein said first dye is red leuco blue.

14. The game card of claim 13 wherein said second dye is blue.

15. A game card comprising:

a substrate;

a plurality of play indicia printed on said substrate;

a scratch-off coating applied over said play indicia;

a plurality of marking indicia printed on said substrate; and a pressure sensitive agent including a color former, an activator and a plurality of stlit particles applied to said marking indicia to produce a change in color of said marking indicia in response to pressure applied to said marking indicia by a player.

16. The game card of claim 15 wherein said stilt particles have a diameter of 10–32 microns.

17. The game card of claim 15 wherein at least a portion of said stilt particles are composed of starch.

18. The game card of claim 15 wherein at least a portion of said stilt particles are composed of polypropylene.

19. The game card of claim 15 wherein said color former includes a microencapsulated dye.

20. The game card of claim 19 wherein said microencapsulated dye has a diameter of 4–10 microns and said stilt particles have a diameter of 10–32 microns.

21. The game card of claim 15 wherein said activator is microencapsulated.

22. The game card of claim 15 additionally including a clear abrasive resistant coating covering said pressure sensitive agent.

23. The game card of claim 22 wherein said clear abrasive resistant coating includes vinyl resin.

24. The game card of claim 22 wherein said clear abrasive resistant coating includes an ultra-violet cured seal coat.

25. A game card comprising:

a substrate;

a plurality of play indicia printed on said substrate;

a scratch-off coating applied over said play indicia;

a plurality of marking indicia printed on said substrate; and security means for detecting cutting of the substrate in the area of said marking indicia wherein said security means includes a pressure sensitive agent having a color former and an activator applied over at least a portion of said marking indicia.

26. The game card of claim 25 additionally including a clear abrasive resistant coating covering said pressure sensitive agent.

27. The game card of claim 26 wherein said clear abrasive resistant coating includes vinyl resin.

28. The game card of claim 26 wherein said clear abrasive resistant coating includes an ultra-violet cured seal coat.

* * * * *